US006192816B1

(12) United States Patent
Rovin et al.

(10) Patent No.: US 6,192,816 B1
(45) Date of Patent: Feb. 27, 2001

(54) METHOD AND APPARATUS FOR FORMING AND JOINING HEMS PARTICULARLY ON TUBULAR TROUSER LEGS

(75) Inventors: Herman Rovin, Greenville; August Feuerbacher, Easley; Michael J. Banks, Greenville, all of SC (US)

(73) Assignee: Techstyle Corporation, Piedmont, SC (US)

( * ) Notice: Subject to any disclaimer, the term of this patent is extended or adjusted under 35 U.S.C. 154(b) by 0 days.

(21) Appl. No.: 09/418,793

(22) Filed: Oct. 15, 1999

(51) Int. Cl.[7] ..... B05B 35/02

(52) U.S. Cl. ..... 112/475.06; 112/141; 112/470.31

(58) Field of Search ..... 112/475.12, 475.13, 112/475.06, 63, 470.07, 470.08, 470.13, 470.17, 470.18, 470.29, 470.31, 141, 147–149, 153, 305, 308, 309, 475.09

(56) References Cited

U.S. PATENT DOCUMENTS 3,865,058 2/1975 Rovin et al. .
4,098,204 * 7/1978 Kojima ..... 112/153 X
4,191,117 * 3/1980 Della Torre ..... 112/470.31 X
4,760,809 * 8/1988 Nakatani et al. ..... 112/141 X

FOREIGN PATENT DOCUMENTS

2249686 * 10/1987 (JP) ..... 112/63

* cited by examiner

*Primary Examiner*—Ismael Izaguirre
(74) *Attorney, Agent, or Firm*—Schweitzer Cornman Gross & Bondell LLP

(57) ABSTRACT

Method and apparatus for forming and joining large and small hems particularly on denim jeans and other types of trousers. An internally folded large hem is formed mechanically and in a highly accurate manner by engaging the end portion of a trouser leg under circumferential tension and folding a projected hem margin into the trouser leg while supporting opposite sides of the trouser leg in a region immediately adjacent to the desired hem fold line. A full depth small hem may be formed by compressing a limited portion of the large hem into a fold, with the raw edge of the fabric positioned substantially at the fold line of the large hem. The configuration of the compressed limited portion is retained until the sewing machine is in position to grip it and commence sewing. A continuous fold former is brought into position before sewing is commenced to complete the small hem folding initiated by the initial compression. Novel handling facilities to facilitate the handling of trousers during loading, unloading and processing operations.

14 Claims, 10 Drawing Sheets

METHOD AND APPARATUS FOR FORMING AND JOINING HEMS PARTICULARLY ON TUBULAR TROUSER LEGS

BACKGROUND AND SUMMARY OF THE INVENTION

The present invention is directed to a method and means for progressively forming and joining hems at the bottoms of trouser legs and the like.

In the production of a typical pair of denim jeans, for example, it is conventional to form a so-called "large hem" at the raw cut bottom edge of each leg. A portion of the large hem is then turned under, to form a small hem, which is captured between the remainder of the large hem and the wall of the trouser leg.

In the production of denim jeans, the hemming of the legs typically is one of the last operations to be performed, and it is customarily performed with the jeans in a "right-side-out" orientation. This requires that the large hem be folded inside of the trouser leg. Thereafter, a small hem is folded inside of the large hem, to lie between the large hem and the wall of the pant leg. Heretofore, the operation of folding the large hem has had to be performed manually, which creates very significant problems. Apart from the obvious labor-intensive aspect, the performance of the large hem fold, internally of the pant leg, is a blind operation, depending upon the finger skill and dexterity of the operator. There is a resulting lack of uniformity in the folding operation. Although facilities are known and available for automatically performing the subsequent small hem fold, the small hem fold cannot be performed properly if the large hem is not formed with a reasonable degree of uniformity. As will be appreciated, a defective hem on an otherwise finished garment can result in a costly reject. Additionally, the unusual manipulative steps required of the operator tend to result in a high level of problems with so-called carpel tunnel syndrome.

It is accordingly one of the significant objectives of this invention to provide a novel and improved apparatus and technique for automatically forming an in-turned large hem on a trouser leg, minimizing operator manipulations and providing a high level of uniformity and repeatability.

In the production of denim jeans, and especially "stone-washed" jeans, the raw edge of the unhemmed pant leg is of greatly reduced strength and durability. Thus, it is desired that the small hem be much deeper than normal, to avoid the likelihood of the raw edge of the small hem pulling out from the sewn hem. Accordingly, a further objective of the present invention is the provision of a hem-forming method and apparatus capable of forming a full depth small hem such that the raw edge of the small hem is seated substantially at the fold line of the large hem. This provides a maximum margin of the raw fabric edge beyond the sewing line of the hem, assuring a hem of maximum strength and durability.

Yet another objective of the invention is the provision of novel and highly efficient facilities for handling of trousers during hem-forming and sewing operations. After loading of a trouser onto the handling apparatus, the trouser is automatically moved to a position in front of the sewing machine to enable the hemming operations to be carried out successively on the two legs of the trouser. Thereafter, the completed trouser is shifted away and a new one brought in to position. The arrangement is such as to optimize the efficiency and utilization of the associated hem forming and sewing equipment, and potentially enabling a single operator to handle more than one station.

For a more complete understanding of the above and other features and advantages of the invention, reference should be made to the following detailed description of preferred embodiments of the invention and to the accompanying drawings.

DESCRIPTION OF PREFERRED EMBODIMENTS

Figure 1:
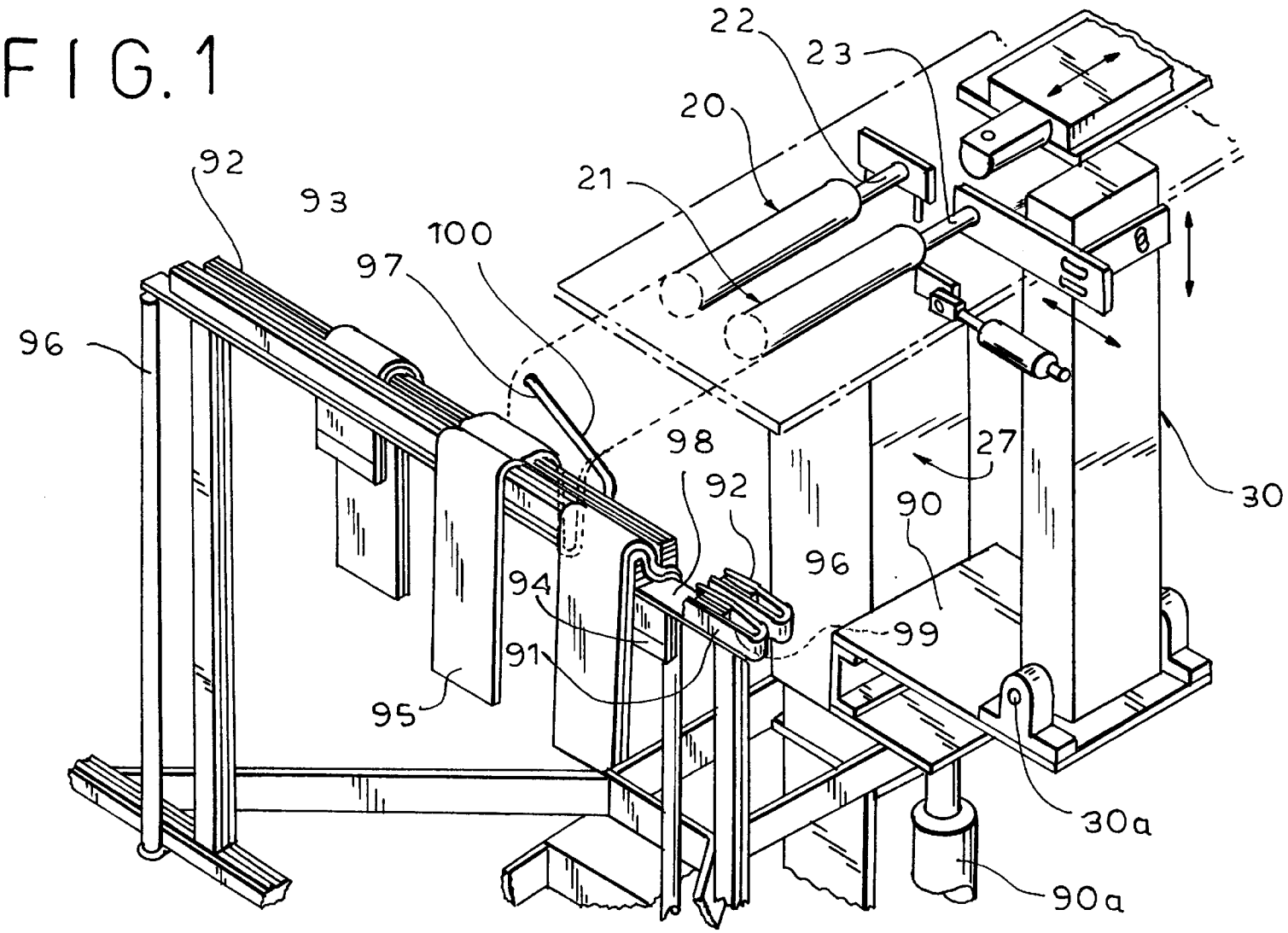
FIG. 1 is a simplified perspective illustration of a hem forming and sewing station incorporating principles of the invention.

Referring now to the drawing, and initially to FIGS. 1–4 thereof, the reference numerals 20–21 designate generally fixed and moveable roller assemblies, respectively, utilized in accordance with the invention for internally engaging a trouser leg during hem forming operations. The respective roller assemblies 20–21 include fixed supporting sleeves 22–23, which extend internally of outer sleeves 24–25, enabling rotation of the latter, as will be further described. The roller assembly 20 is mounted on a fixed support 26, forming part of a basic machine frame structure 27 mounting a sewing machine 28.

Figure 2:
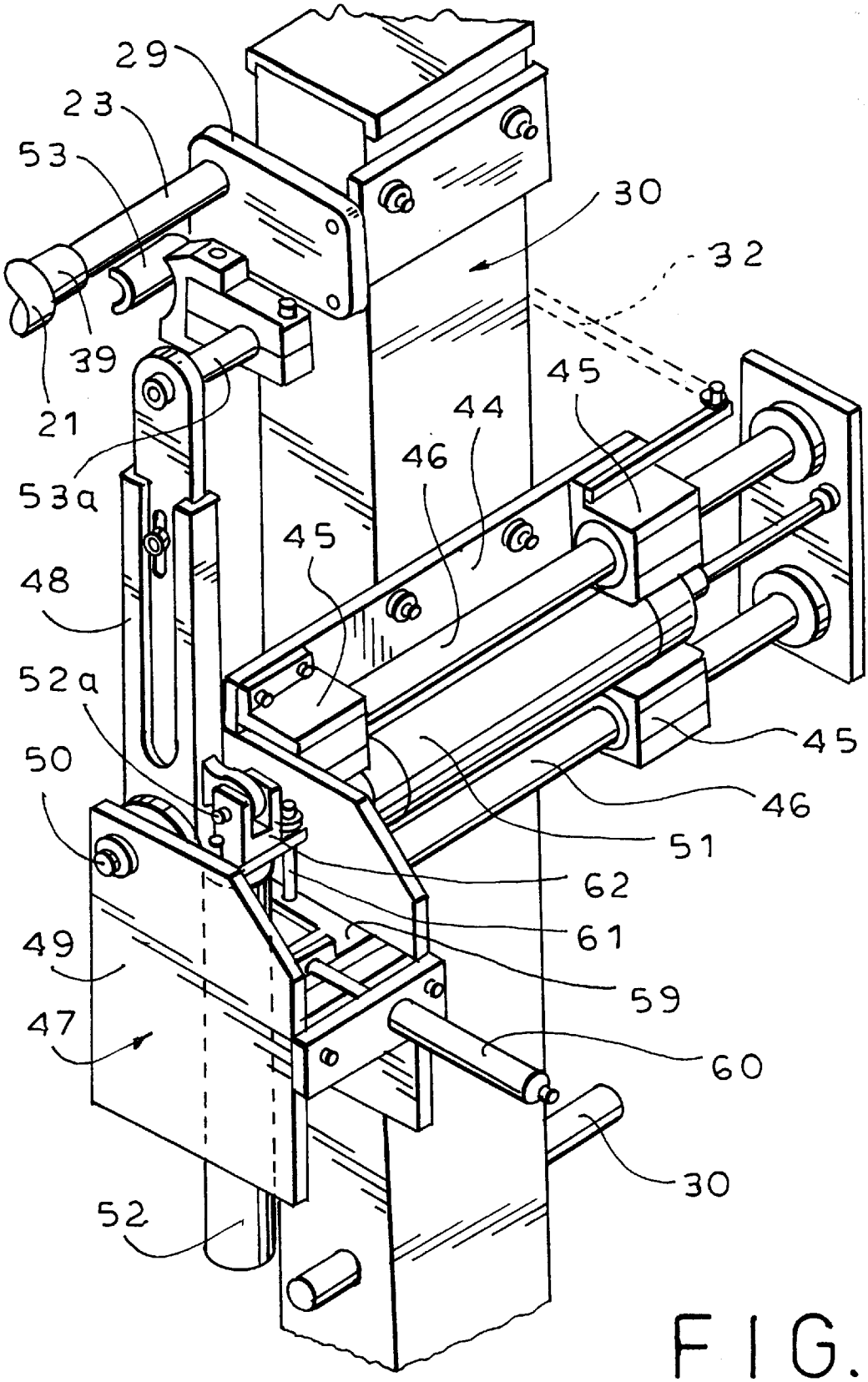
FIG. 2 is an enlarged, fragmentary perspective illustration of a portion of the apparatus of FIG. 1, illustrating features of the large hem forming apparatus.

The moveable roller assembly 21 is mounted on an arm 29 forming part of a pivot arm assembly 30 (FIG. 2). The pivot arm assembly is mounted to the basic frame structure 27 by means of a pivot rod 30*a* and is controllably pivoted through a limited angle by a low pressure actuator 31, for example, to enable the moveable roller assembly 21 to be moved away from the fixed assembly 20, against the action of a return-spring 32.

According to the invention, the moveable roller assembly 21 has a "closed" or loading position in which the pivot arm assembly 30 is pivoted toward the fixed roller 20, facilitating the application over the ends of the rollers of the open end of a tubular pant leg. After positioning of the pant leg over the "closed" rollers, the actuator 31 is operated to pivot the arm assembly 30 to move the roller assemblies apart and place the pant leg under light circumferential tension for the hem folding and sewing operations.

Figure 4:
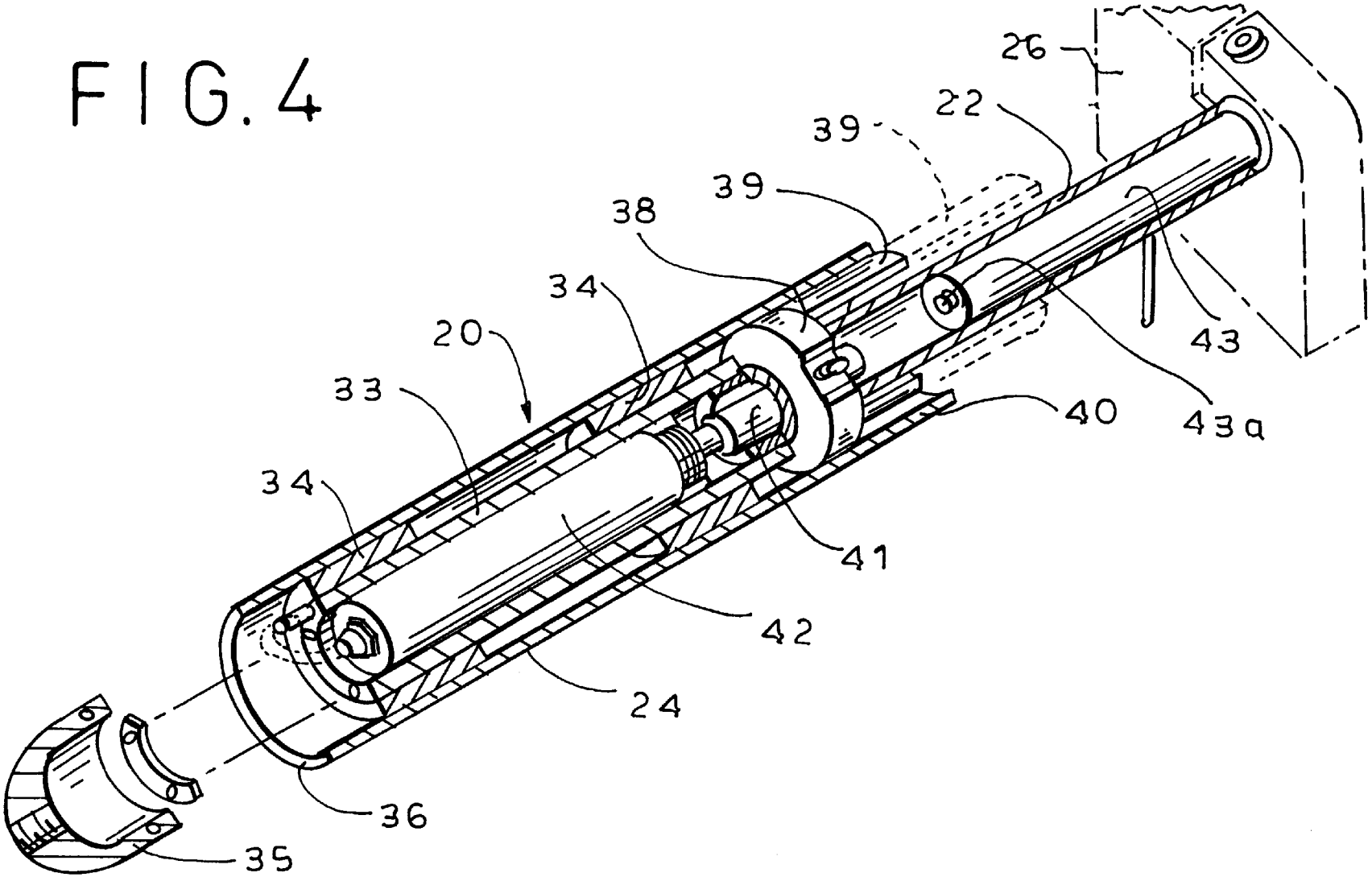
FIG. 4 is an enlarged, fragmentary perspective view, with parts broken away, showing details of a supporting roller according to the invention, used in the large hem forming operation.

The structure of the individual roller assemblies 20–21 is the same on both sides and is shown generally in FIG. 4, illustrating specifically the fixed roller assembly 20. The tubular mounting sleeve 22 extends outward and joins an outer tubular support 33. Spaced apart bearings 34, carried by the tubular support, rotatably mount the outer roller sleeve 24 for free rotation. A rounded entry guide 35 is fixed to the end of the outer tubular support 33 and projects beyond the outer end 36 of the roller to facilitate the application of a tubular pant leg over the roller assembly.

Slidably mounted on the outer tubular guide 33 is a horn assembly 37 comprising a slide ring 38 and a folding horn 39 fixed thereto and extending toward the open end of the rotatable sleeve 24. The folding horn, which is of semi-cylindrical configuration, has a retracted position in which the free end is approximately flush with the forward end 40 of the rotatable sleeve 24. Through a suitable slot (not shown) in the outer portion of the fixed sleeve 22, the slide ring 38 is connected to the operating rod 41 of a fluid actuator 42 fixed within the mounting sleeve 33. The folding horn 39 can be extended to the dotted line position shown in FIG. 4 by operation of the actuator 42. Retraction of the horn is effected by an opposed actuator 43, housed within the fixed sleeve 22, and having a projectable rod 43a arranged to push against the rod 41 to effect its retraction, carrying with it the slide ring 38 and folding horn 39.

Figure 3:
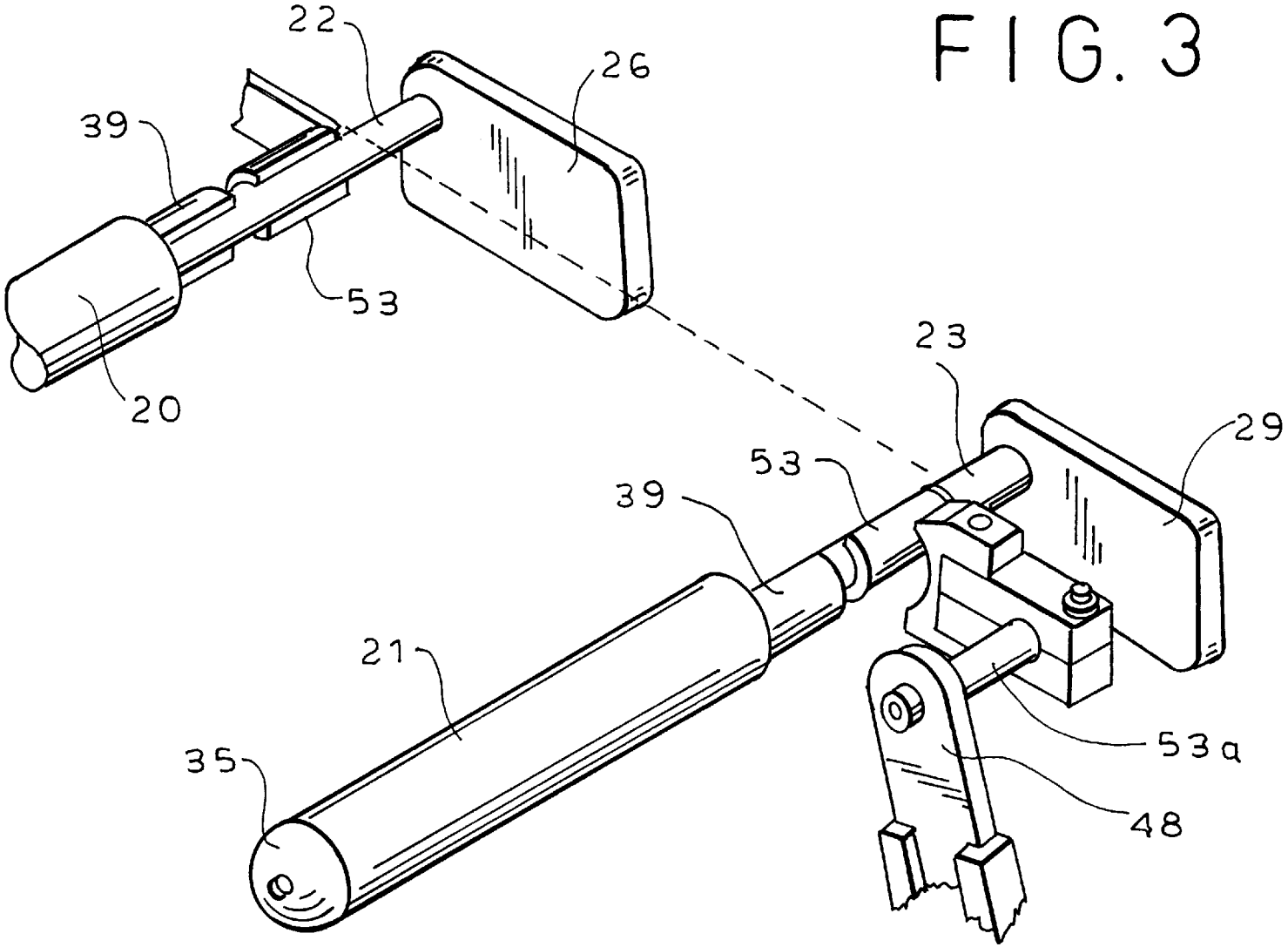
FIG. 3 is a fragmentary perspective view showing further details of the large hem forming apparatus of the invention.

Each of the roller assemblies 20–21 has associated therewith a fold forming mechanism. FIG. 3 shows details of the fold forming mechanism for the moveable roller assembly 21, and it will be understood that a corresponding mechanism is provided for the fixed roller assembly 20.

With reference to FIG. 2, a mounting bracket 44 is fixed to the moveable arm assembly 30 and carries pairs of linear guide-bearings 45 carrying moveable guide rods 46. The guide rods carry a moveable folder support mechanism 47 for movement over a predetermined stroke parallel to the axes of the roller assemblies 20–21. The folder support mechanism includes a pivot arm 48 mounted in a bracket 49 for limited movement about a pivot axis 50. The entire mechanism 47 is moveable in a direction parallel to the guide rods 46 by means of a fluid actuator 51 mounted on the bracket 44. A second fluid actuator 52 is carried by the bracket 49 and is connected to the pivot arm 48 by a pivot connection 52*a* for controlled pivoting action of the pivot arm 48.

At its upper end, the pivot arm 48 carries a fixed support rod 53*a*, which in turn carries a semi-cylindrical fold forming element 53 positioned to be moved laterally toward and away from the tubular support rod 23 of the roller assembly.

Figures 5, 6:
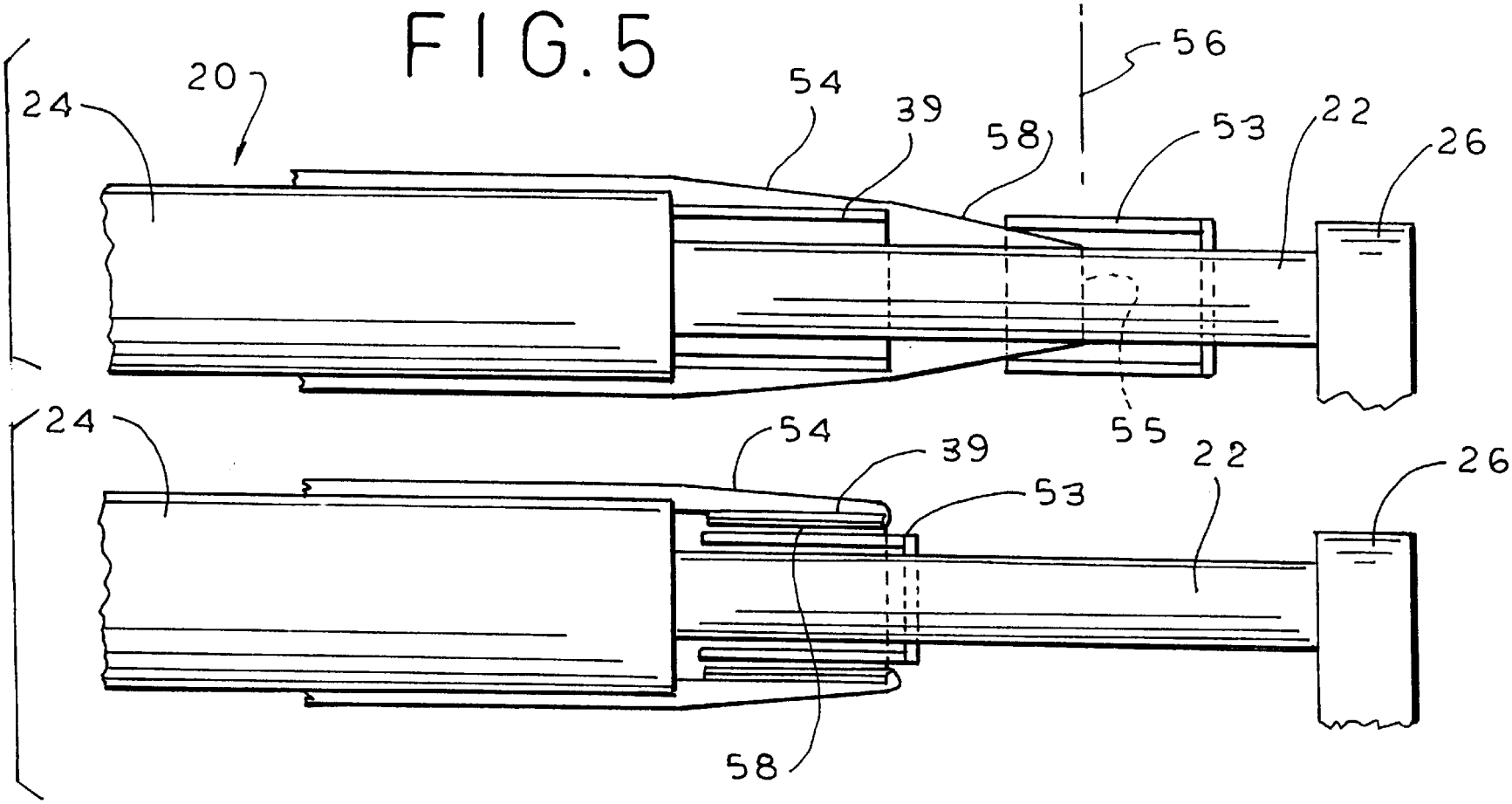
FIGS. 5 and 6 are sequential views illustrating principles of the large hem forming operation.

In the forming of a large hem-fold in accordance with the invention, the open-end of a trouser leg 54 is applied over the roller assemblies 20–21 while the moveable roller assembly 21 is positioned in a closed or "load" position somewhat closer to the fixed roller assembly 20 than the internal width of the trouser leg. At this stage of the operation, the actuator 42 and the associated folding horn 39 are extended, and the semi-cylindrical fold forming element 53 is retracted axially away from the horn sleeve and also laterally away from the roller mounting rod 22 (see FIG. 5). The sewing machine 28 at this point in the process is in a retracted position.

Pursuant to the invention, after the trouser pant 54 is applied over the rollers, the actuator 31 is operated to move the roller 21 in a separating direction and apply a light circumferential tension to the pant leg. The operator then adjusts the pant leg longitudinally along the rollers until the raw edge 55 of the pant leg is accurately aligned with a reference. To this end, the equipment advantageously incorporates a commercially available device to form a sharp laser-generated reference line 56 at the desired reference point. When the pant leg is applied over the rollers, the sharp red laser line appears at the end of the pant leg when it is properly aligned. Typically, the cut end of the pant leg may not be-precisely at right angles to the pant leg, and the operator can readily adjust the pant position to achieve the best average position of the cut edge relative to the reference line 56.

Desirably, as will be explained in more detail hereinafter, the reference device also applies a longitudinal laser reference line 57 to facilitate a predetermined alignment of the side-seam of the pant leg with respect to the sewing machine.

After positioning of the pant leg 54 in its desired alignment, actuators 52 are activated to pivot the semi-cylindrical fold forming elements 53 into a position concentrically between the supporting rods 22–23 and the now-projected folding horns 39. The actuators 51 for both fold-forming assemblies are then operated to advance the fold forming elements axially outward, engaging the forward margin 58 of the pant leg and folding it under the semi-cylindrical folding horns 39, as reflected in FIG. 6. By maintaining the trouser leg 54 under a slight circumferential tension during the projection of the fold forming elements 53 into the projected horns 39, the large hem fold is created over the entire circumference of the pant leg.

Once the large hem fold is completed, a small hem fold may be formed, to lie between the large hem and the outer wall of the pant, by any of a variety of means, including some that are well known in the prior art, such as, for example, the continuous fold device disclosed in my earlier U.S. Pat. No. 3,865,058. A particularly desirable and advantageous mechanism for this purpose, however, forms one of the features of this invention, to be described hereinafter, which effectively can be employed to form a full-depth small hem fold useful particularly in connection with stone-washed jeans, for example.

In order to perform any kind of sewing operation after forming of the large hem, it is necessary to retract the folding horns 39, which would otherwise prevent the passage of a sewn seam. Accordingly, at this time, the actuators 43 may be activated to extend the respective operating rods 43*a* and push the horns back into their retracted positions, as shown in FIG. 4. In order to avoid slackness in the folded area of the trouser leg, it is desirable at this time to retract laterally the fold forming elements 53 to a position, shown generally in FIG. 7 such that the hem folded portion of the trouser leg is supported under slight circumferential tension by outer surfaces of the retracted fold forming elements.

Figure 7:
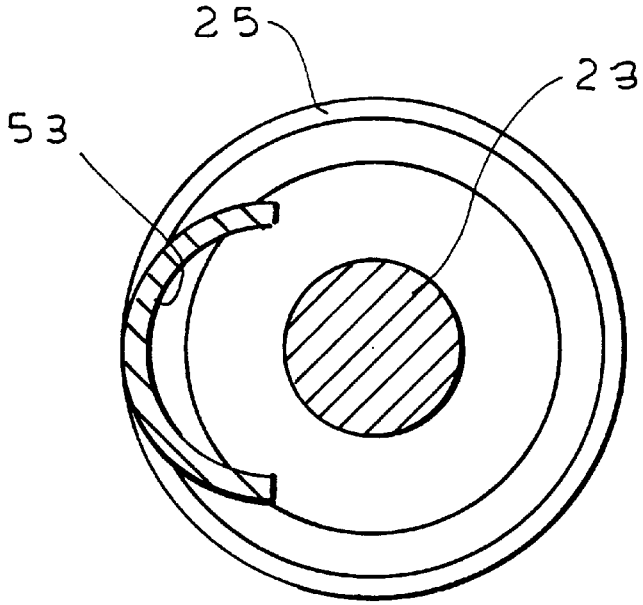
FIGS. 7 and 8 are fragmentary cross-sectional views illustrating operations involved in the forming of a large hem according to the invention.
Figure 8:
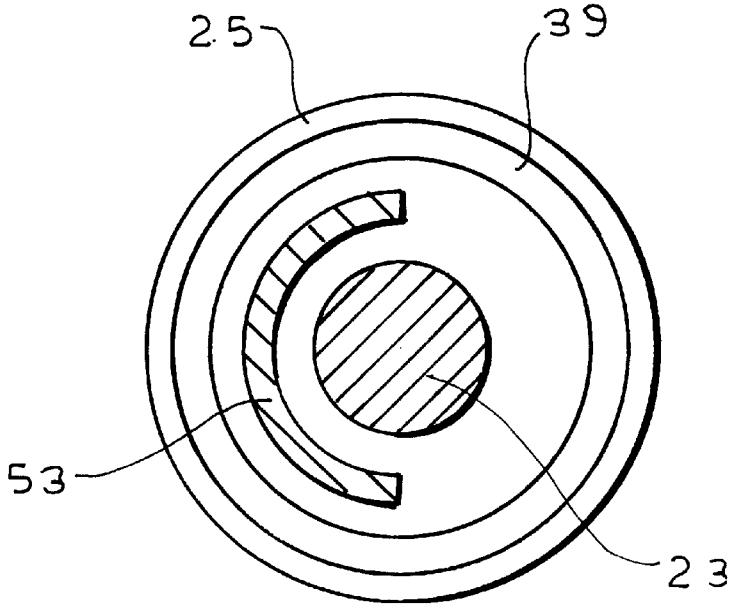

As will be appreciated, for loading of an unfolded trouser leg onto the rollers 20–21, it is desired that the fold forming elements 53 be pivoted laterally to a fully retracted position spaced well away from the roller assemblies 20–21, so as to not interfere with the mounting and positioning of the trouser leg. After the folding of the large hem, and the retraction of the folding horns 39, however, the fold forming elements 53 are retracted only to a predetermined intermediate position, as shown in FIG. 7, to provide the desired support of the folded hem. For this purpose, a retractable limit stop element 59 is carried on the fold former bracket 49 and is moveable by a fluid actuator 60 (FIG. 2). An adjustable stop-rod 61 is moveable with the operating element 62 of the tilt actuator 52, and is engageable with the stop element 59. For full retraction of the fold forming elements 53 to their out of the way "load" positions, the stop element 59 is retracted, to a position out of alignment with the stop rod 61, allowing complete retraction. However, when the actuator 52 is operated to move the fold forming element 53 into a folding position, close to the support rods 22–23, the stop block 59 is advanced by the actuator 60 to the position shown in FIG. 2, underlying the stop element 61. Thereafter, when the fold forming elements are retracted by operation of the actuators 52, the limit stop elements 59, 61 cooperate to limit the retracting movement to the desired intermediate position, shown in FIG. 7.

As will be appreciated, the formation of the in-turned large hem fold in the manner of the invention assures a highly precise folding and positioning of the raw edge of the fabric. It is a simple matter for the machine operator to align the trouser leg accurately with the laser line 56, after which the apparatus proceeds with a series of accurately controlled operations effecting a folding of the edge of the fabric around the folding horns 39. This operation completely avoids the uncertainties of the prior art practice, in which the skill and sensitivity of the operator's fingers was the only means of controlling the large hem folding operation. Even where the raw edge of the trouser leg is not squarely cut, the operator can easily position the misaligned edge to achieve an optimum average position in relation to the laser line, so that optimum results are achieved in the folding operation.

Quite apart from the greatly increased precision and efficiency of the described large hem folding operation, the practice of the invention is beneficial to the work force in avoiding incidents of carpel tunnel syndrome and other maladies resulting from the awkward, repetitive manipulations required of an operator in the manual forming of the large hem fold.

As previously mentioned, after performing the large hem fold in accordance with the invention, the small hem fold may be formed by any of a variety of useful techniques known for this purpose. However, the invention particularly contemplates the use of a new and advantageous method and apparatus for forming the small hem fold, to the full depth permitted by the size of the large hem fold. This is particularly important and desirable in connection with fabrics, such as stone-washed denim, where the raw edge of the fabric may be severely weakened, and it is important to maximize the fabric margin beyond the sewing line, so as to minimize the likelihood of the hem tearing out. A new form of small hem folder adapted to this purpose is illustrated in FIGS. 12–16.

Figure 12:
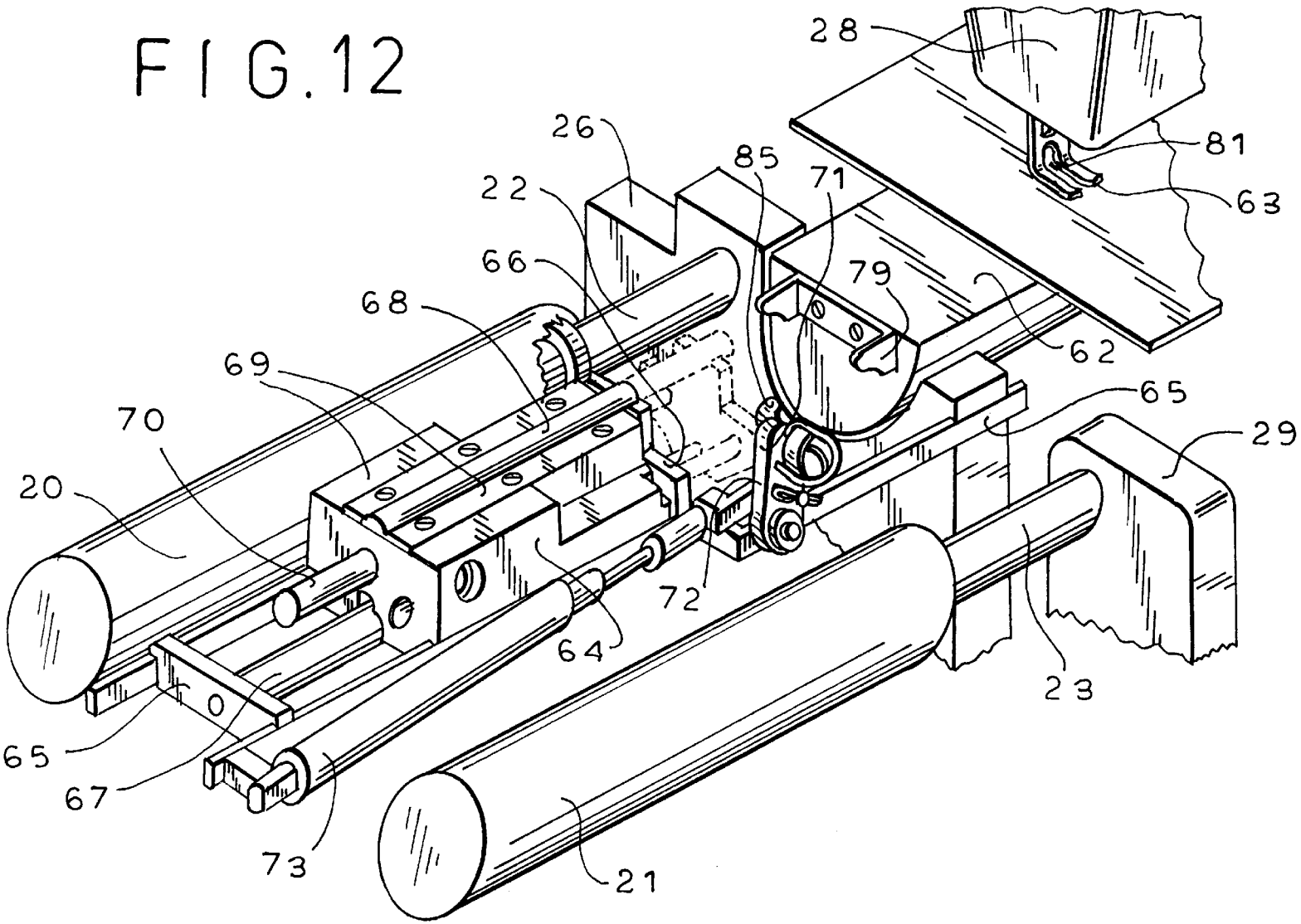
FIG. 12 is a fragmentary view illustrating a novel form of mechanism for forming a full-depth small hem on the inside of a tubular pant leg.

FIG. 12 illustrates basic elements of the apparatus, including the sewing machine 28 which, in the illustration of FIG. 12, is shown in a retracted position. In the retracted position, the cylinder bed or snout 62 of the sewing machine is withdrawn to a position such as to accommodate the initial loading and positioning of the trouser leg and the operations necessary to perform the large hem fold. According to the invention, once the large hem folding operation has been completed, the folding horns 39 have been retracted longitudinally into the rollers 20–21, and the respective fold forming elements 53 have been retracted laterally a distance suitable to maintain the region of the large hem fold under modest tension, the small hem folding operations can commence.

According to the invention, the small hem folding operation involves several steps, performed in sequence. In the first step, a short length of the large hem fold, along an upper portion of the trouser leg, is pressed outward toward the folded edge of the leg, to form a vertically oriented folded loop of approximately one half the width of the large hem fold. The folded loop is formed directly in front of the cylinder bed of the sewing machine, which is then advanced forward, underneath the loop, causing the loop to be folded horizontally on top of the cylinder bed in position for sewing. At this stage, the elements employed in forming the initial small hem loop fold are (or have been) withdrawn, and the sewing machine presser foot 63 is lowered over the top of the trouser leg in position for sewing of the completed hem. Desirably, the location of the sewing needle is approximately one-sixteenth of an inch from the small hem fold. With the balance of the small hem tuck extending between the large hem and the outer wall of the trouser leg, to a point near the large hem fold.

In the area immediately adjacent the folded loop, the large hem fold undergoes a transition between the narrower-twice folded loop and the full-width once folded large hem fold. When the sewing machine is in position holding the folded area of the small hem, a continuous tuck-folder is brought into position in the transition area "upstream" of the sewing needle in a position to continuously loop and fold the small hem as the fabric is advanced during sewing. Sewing of the hem can then proceed until the sewn seam travels around and approaches the continuous tuck-former. At this stage, the folded and sewn hem will be substantially complete, and the formation of the hem folds will be effectively completed over the short distance that has not yet passed through the tuck former. The tuck former may thus be withdrawn and the sewing operation finished.

With reference particularly to FIG. 12, the small hem folding mechanism comprises a main block 64 carried by a frame 65 secured rigidly to the main machine frame 27. A loop former element 66 is positioned at the forward end of the block 64 and is mounted for controlled movement toward and away from the sewing machine 28 by means of a fluid cylinder 67 carried by the block 64.

Along the top of the block 64 is a loop retainer strip 68 guided for longitudinal movement along the block by spaced guide rails 69 and controlled by means of a fluid cylinder 70.

A continuous tuck former 71, itself of known construction (for example, see my earlier U.S. Pat. No. 3,865,058) is mounted on a pivot bracket 72, which is pivoted on the frame 65. A fluid cylinder 73 engages the pivot lever 72 and can be operated to move the continuous tuck former between an operative position, as illustrated in FIG. 12, and a retracted, inoperative position. During the large hem folding operations, and the initial portions of the small hem folding operations, the continuous tuck former is held in a retracted position.

Figure 13:
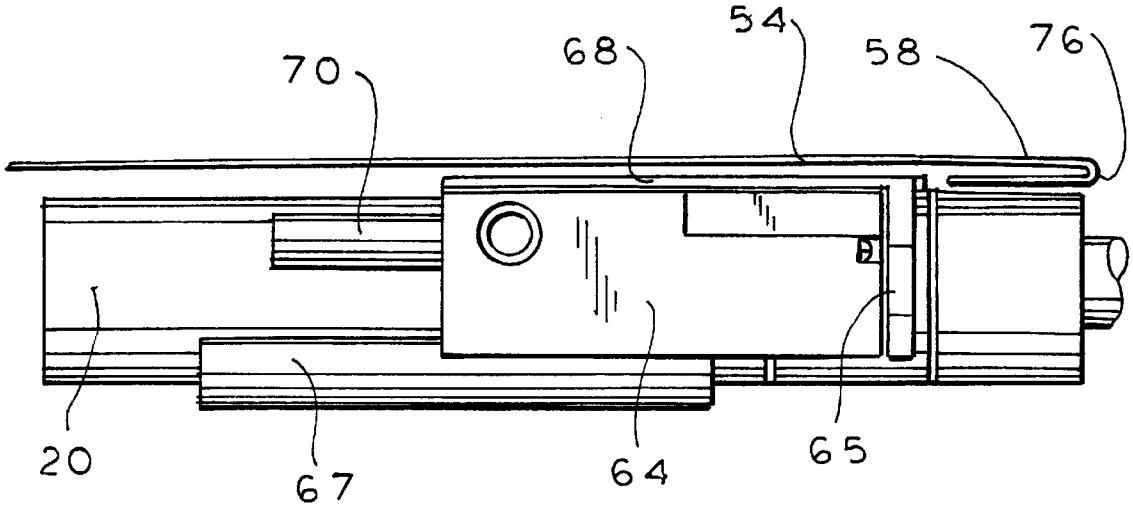
FIGS. 13–16 are sequential views illustrating the formation of a full-depth small hem according to principles of the invention.
Figure 14:
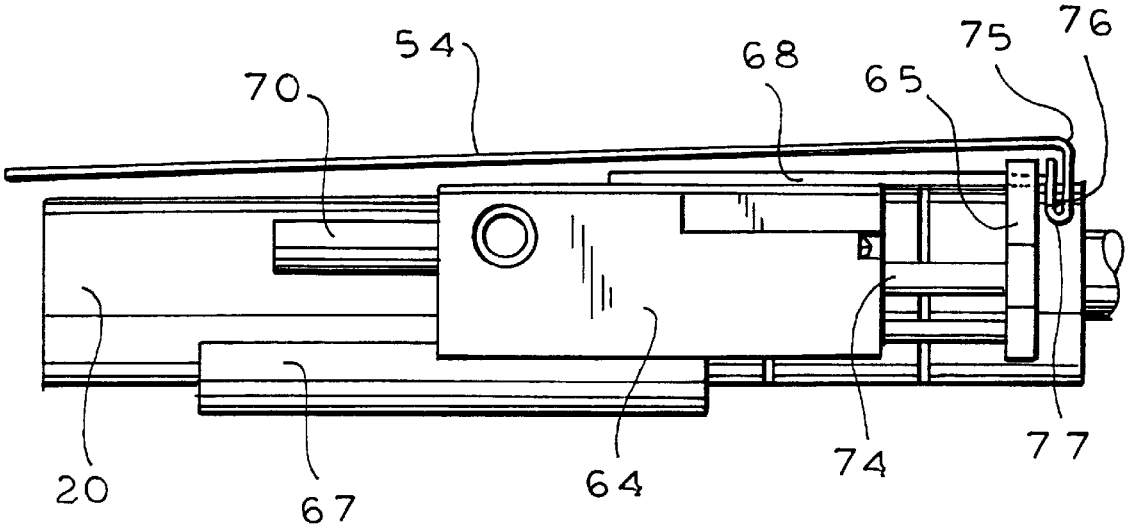

At the end of the large hem forming operation, the pant leg 54 and large hem 58 are generally as shown in FIG. 13 (illustrating the top layer only), being held under light tension by separating forces on the rollers 20–21 and fold forming elements 53. At this time, the fluid actuator 67 is operated to advance the loop former 66, carried by guide rods 74, to a forward limit position, shown in FIG. 14. The loop retaining element 68 may also be advanced at this time to its forward position, illustrated in FIG. 14. The loop forming element, as it moves forward, engages the tensioned large hem fold directly in front of it and pushes it forward toward the large hem fold line 75. The forward limit position of the loop former 66, shown in FIG. 14, is such that the area of large hem fold directly in front of the fold forming plate forms a vertical loop, with a small hem section approximately one half the length of the large hem panel. A small hem fold line 77 is formed at the bottom of the loop. The loop forming element 66 is positioned directly in front of the cylinder bed 62 of the sewing machine, and is of limited width, for example 2 or 3 inches, so that only a relatively short length of the large hem is formed into the vertical loop. In other areas, the large hem remains in the condition shown in FIG. 13, except that there is, of course, a curved transition area between areas of the vertical loop, shown in FIG. 14 and the horizontal fold, shown in FIG. 13, as will be understood.

Figure 15:
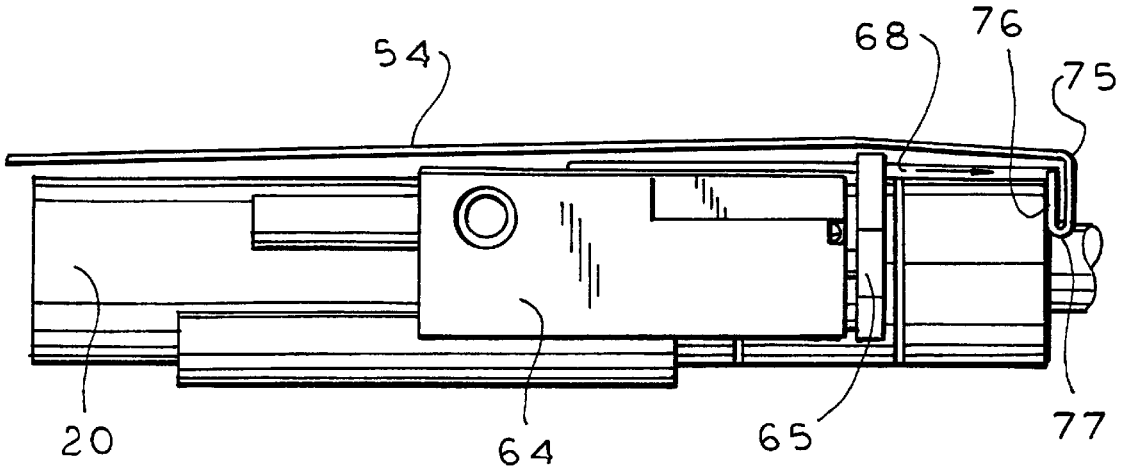

After initial forming of the short hem fold, shown in FIG. 14, the fold forming plate 65 is retracted. The fold retainer 68 is, however, retained in position (FIG. 15). The fold retaining element 68 is a relatively thin strip , which engages the short hem fold near its free edge, and serves temporarily to prevent the folded area from returning to a condition shown in FIG. 13.

Figure 16:
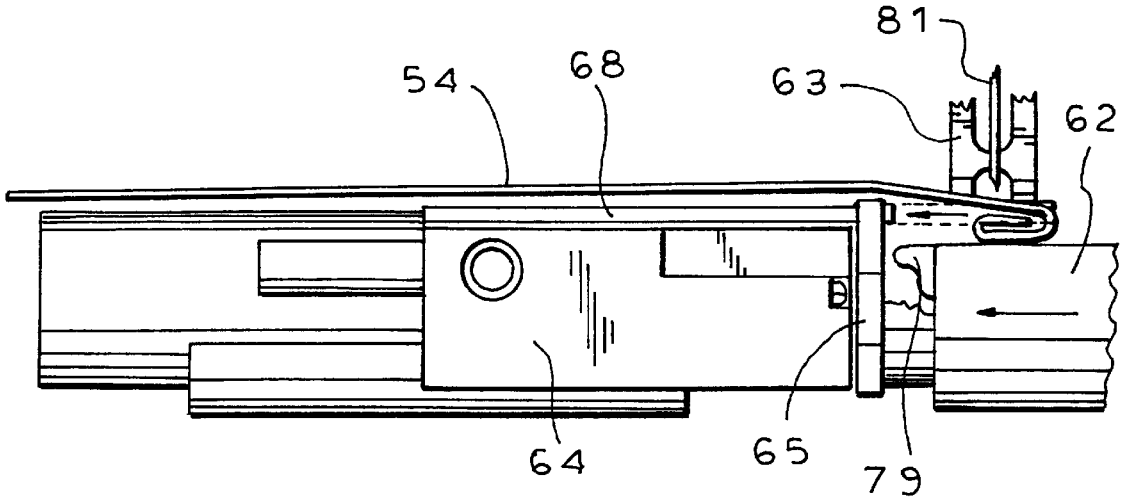

At this time, the sewing machine 28 is advanced in the forward direction (i.e. toward the operator) to bring the cylinder bed 62 to a position underlying the folded hems. A pair of spaced apart lifting elements 79 are positioned at the front of the cylinder bed and as the sewing machine is advanced these lifting elements engage the depending vertical loop of fabric and pivot it around the large hem fold line 75. The cylinder head 62 is advanced to a position completely underlying the fully folded hem section, as shown in FIG. 16. The short section of fully folded hem is now securely confined, and the retainer element 68 can be retracted to the position shown in full lines in FIG. 16. The sewing machine presser foot 63 at this time is lowered to a position on top of the fully folded hem, ready for the sewing operator to commence.

Figure 11:
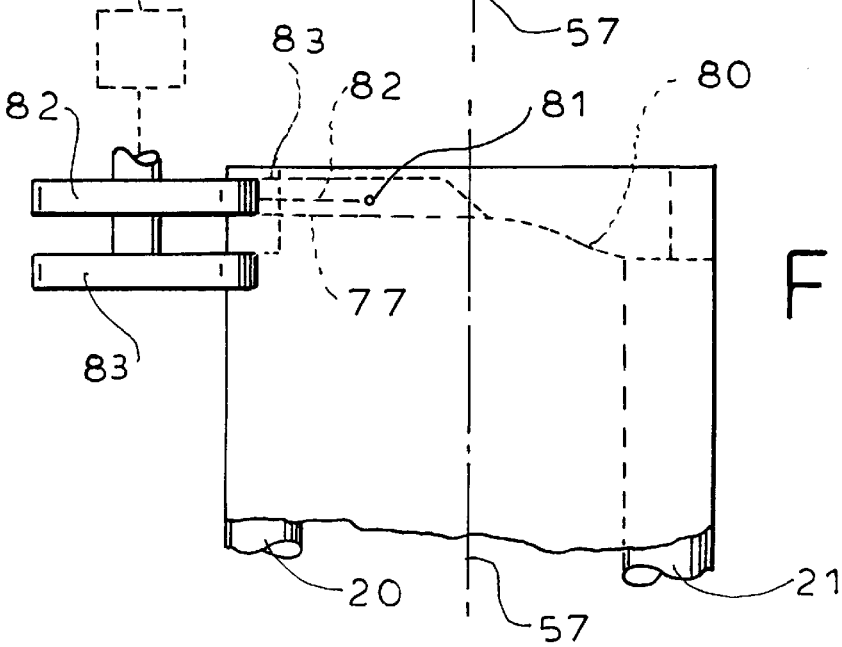

After the sewing machine has been positioned as shown in FIG. 16, the continuous tuck former 71 is pivoted upward and toward the sewing machine, to engage the hem in a transition area 80 (FIG. 11) which is upstream of the sewing needle 81. The sewing operation may then commence, forming stitches along a line 82, which is preferably located close to the small hem fold line 77. Because of the accuracy and reliability of the automated fold forming operations, the stitch line can easily be located approximately one-sixteenth of an inch from the small hem fold line 77, providing for a substantial margin of fabric between the stitch line 82 and the raw end 83 of the small hem fold.

Figure 10:
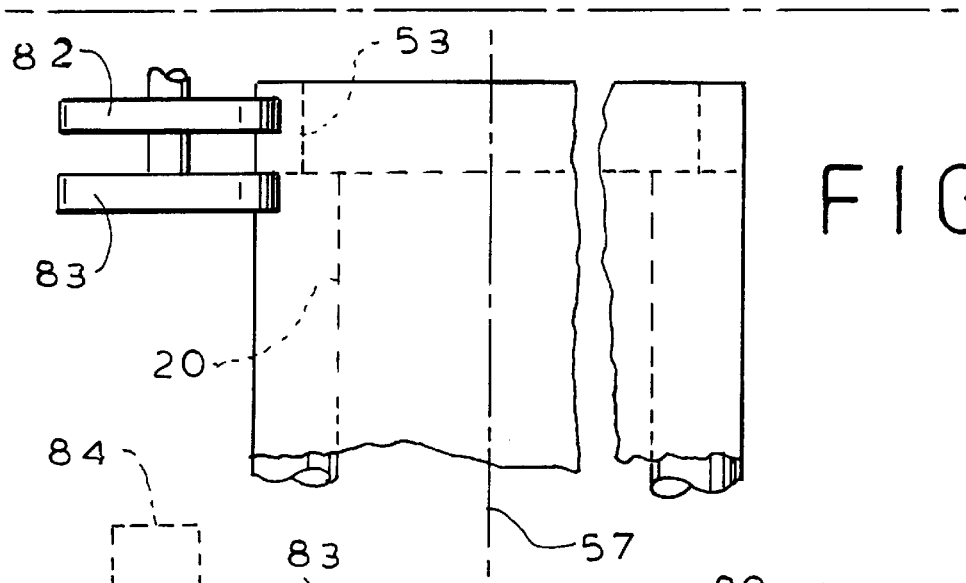

As a hem sewing operation commences, the fabric is moved along the sewing path by feed dogs (not shown) of the sewing machine. In addition, the apparatus of the invention advantageously incorporates secondary fabric feed means in the form of at least one, and preferably a pair of resilient drive wheels 82–83 which bear upon the fabric, downstream of the sewing position, in areas where the fabric is supported. As illustrated in FIG. 10, the drive wheel 82 contacts the fabric opposite the underlying hem fold element 53, whereas the drive wheel 83 contacts the fabric opposite a portion of the roller 20. The drive wheels 82–83 are driven by a motor 84, which is electronically slaved to the operations of the sewing machine feed dogs, such that the fabric downstream of the sewing needle 81 is maintained under a very slight tension. This helps to achieve uniformity and straightness in the sewing operation.

As the sewing operation nears completion, the forwardly positioned continuous tuck former, which lies in the path of the hem stitching, eventually will be engaged by the returning stitch line. A projecting element 85 of the continuous former is engaged by the stitching and is displaced outwardly as the stitch line continues to be advanced by the sewing mechanism. The displacement of this element is detected by a suitable sensor, which signals the end of the sewing operation. The fluid actuator 73 is operated to fully retract the continuous former mechanism, and a control circuit (not shown) is actuated to commence a countdown of the remaining number of stitches to be formed. The distance to be stitched, after displacement of the former element 85, is known and fixed, so that the machine is controlled to continue for a predetermined number of stitches, to provide at least a slight overlap between the start and end of the stitching.

Because the completion of the sewing operation is controlled by the stitch return sensing arrangement described above, the control is entirely independent of the circumference of the trouser leg. The control need only apply to the distance from the detected return of the stitch line to the end of the stitching. This is a fixed distance, regardless of the circumference of the trouser.

Figure 9:
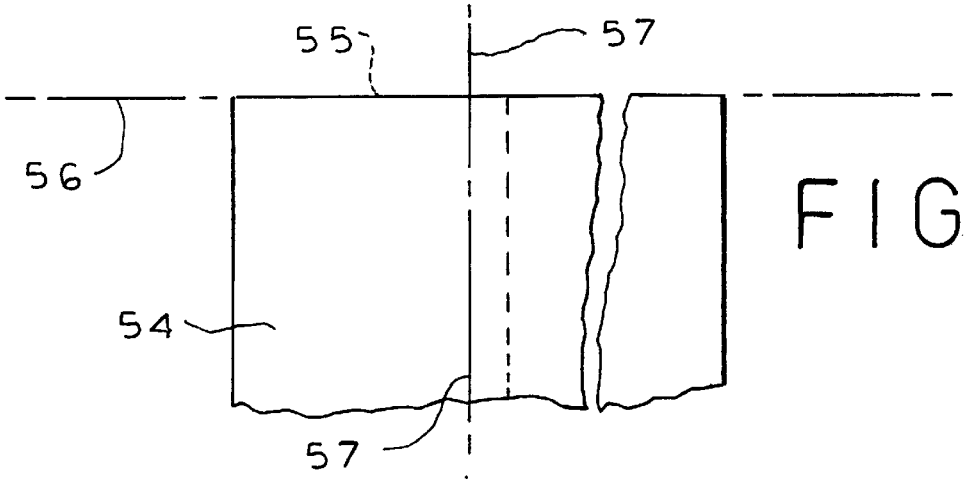
FIGS. 9–11 are simplified representational views illustrating a sequence of operations involved in the forming of a large hem.

In connection with the production of certain types of trousers, particularly denim jeans, for example, the trouser legs typically are formed with inner and outer side seams. With many such trouser constructions, the side seams are fully formed, in that each edge of the fabric is turned over to form a blind hem with the opposite edge. This results in four layers of fabric at the side seam. With heavy denim fabrics, this can result in a thickness of almost one-eighth of an inch of fabric. As will be appreciated, when such trousers are formed with large and small hems, as described herein, the forming of the bottom hems results in a three layer hem. In the immediate area of the side seams, the three layers of hem each constitute four layers of fabric, resulting in a total of 12 overlying layers of fabric at the side seams. It is very desirable, in such cases, that the sewing operation be commenced and completed at or near the side seam. To this end, the longitudinal laser line (FIGS. 9–11), advantageously is positioned to enable the machine operator to align it with a side seam of the trouser leg during the initial loading and aligning operations. This assures that the side seam is properly positioned with respect to the sewing machine at the start of the sewing operations. It also assures that the extremely thick (up to ⅜") side seam areas are not in the area of the folding horns 39 and fold forming elements 53, when the large hem fold is being formed.

The system of the invention advantageously incorporates a novel and highly efficient handling device for the pants being processed on the hem forming and sewing apparatus. With reference to FIG. 1 of the drawing, the reference numeral 90 designates a lift platform associated with a lift jack **90*a*** for raising and lowering the entire folding/sewing mechanism to a level convenient to the machine operator.

The illustrated handling device comprises a pair of front and back rails 91–92 defining between them a vertical space 93 of a size to readily receive a folded trouser, allowing the trouser to be slid easily along the rail structure from right to left in front of the hem folding and sewing apparatus. As shown in FIG. 1, the rails 91–92 are substantially at the level of the rollers 20–21 of the hem folding mechanism. In the intended operation of the handling apparatus, a trouser to be processed is taken from a nearby supply, such as an adjacent cart, and held in flat form by the legs at a point between the waist portion 94 and the unhemmed trouser ends 95, with the trouser legs facing the operator, substantially in the form of an inverted "U". The waist portion of the trousers is slid between the rails 91–92, at an entrance opening 96 at the right hand end thereof, with a substantial length of the trouser legs hanging downward over the front of the front rail 91, as indicated at the right hand side of the rail structure in FIG. 1. The length of legs overhanging the front rail is calculated to be such as to allow the leg to be applied over the hem forming rollers 20–21 in the manner previously described, leaving a sufficient amount of slack 97 to allow the necessary manipulation and rotation of the pant leg during hem forming and sewing.

Advantageously, a horizontal strip 98, illustrated in a broken away portion of the rails 91–92, is secured to the front rail 91 and extends underneath the vertical slot 93 and also underneath at least a portion of the back rail 92, spaced below the latter. As will be evident in FIG. 1, the folded trouser extends downward into the slot and then horizontally to the rear, draping over the back edge of the underlying strip 98. This arrangement allows for the trouser to be easily slid laterally along the handling apparatus, but prevents the trouser from sliding vertically with respect to the handling rack by reason of the action of gravity or tension. The underlying strip 98 advantageously has a tapered end at 99 adjacent the entrance area 96, so that the pants are easily loaded into the slot 93 at the entrance, and are then diverted in the desired manner by the strip at 98.

One or both of the bars 91–92 of the handling apparatus contain internal means (not shown) arranged to engage the trousers and advance them laterally in an incremental fashion to position each in succession in front of and in alignment with the folding and sewing mechanism. Thus, an operator initially loads a first trouser pair onto the handling apparatus and causes it to be moved laterally to a predetermined index position. A second trouser pair is then loaded onto the rack, and the first pair is indexed to a load position in front of the folding/sewing station. Eventually, completed trousers will be indexed laterally to the left to the discharge end of the rack, where an operator may remove them and place them on a suitable rack or cart for further conveyance.

When a trouser pair reaches the hem folding and sewing position, the operator lifts up the outer leg of the trousers, both legs of which are hanging over the front bar 91. The outer leg is applied over the rollers 20–21 in the manner heretofore described, and the series of necessary fold forming and sewing operations is carried out as described. After a first leg has been completed, it is withdrawn from the rollers 20–21, and allowed to hang over the back rail 92. The second leg, which remains over the front rail 91, is now picked up by the operator, applied over the rollers 20–21, and the hemming and sewing operations are performed on the second leg. The second leg is then removed from the rollers and allowed to drape over the back rail 92. The pants are then indexed along the rails, carrying a finished pair, with both legs hanging over the back rail 92, to the left of the forming/sewing station, and bringing a new pair, with both legs draped over the front rail 91, into position and alignment with the hemming/sewing station. The services required of the operator are simple and straightforward. The operator loads the trousers onto the upstream end of the handling apparatus, and removes completed trousers from the downstream end. These operations can be performed while the automatic portions of the hemming and sewing operations are being carried out. The operator's responsibility in the hemming and sewing operations is to load the individual trouser legs over the rollers 20–21, and to align the raw end of the trouser leg and the side seam of the leg accurately with respect to the laser lines 56-57 provided on the equipment.

To advantage, removal of a hemmed and sewn trouser leg from the equipment can be performed quickly and automatically by means of a stripper bar 100. This bar is arranged to overlie the trouser leg, in the region between the back rail 92 and the front ends of the rollers 20–21. When the hemming and sewing operations have been completed, the stripping arm 100 is actuated to move downward in the space between the back bar 92 and the rollers 20–21. The trousers are retained against upward movement between the bars 91–92 by reason of the underlying plate 98. Accordingly, downward movement of the stripping bar causes the trouser leg to be pulled off of the rollers and dropped by gravity behind the back rail 92. While this is going on, the operator can be picking up the remaining leg and readying it for loading over the rollers 20–21. After the processing of the second leg, the operation of the stripping bar 100 can be accompanied by indexed movement of the trousers along the handling apparatus. If desired, provisions can be made to pivot the stripping bar 100 to an out of the way position, as shown in dotted lines in FIG. 1, to facilitate the accessibility of the rollers 20–21 for loading.

The method and apparatus of the invention enable the highly efficient, highly reliable processing of trousers of various sizes and shapes, to perform the leg hemming operations. Not only is the production operation more efficient and less labor intensive, but there is a significant improvement in product quality and product consistency, with substantial reduction in costly reject production.

As can be appreciated, the invention is applicable to shorts as well as full length trousers, and is basically independent of the circumference of the pant leg.

Insofar as I am aware, the method and apparatus of this invention for the first time enables the large hem fold to be performed on a right-side-out trouser leg other than by manually in-folding. By performing this operation mechanically, the accuracy of the large hem fold is assured. This enables the subsequent small hem fold to be reliably performed, and the hem sewing to be completed in a reliable manner. Using the manual procedures heretofore thought to be required, the accuracy of the initial large hem in-fold operation depended upon the finger dexterity of the operator, which at best is less than universally satisfactory. And, if the initial large hem in-fold is not properly performed, the performance of the subsequent operations is severely compromised. Where the leg hemming is the final operation in the manufacturing sequence, the forming of a defective hem causes the entire garment to be degraded, and in some cases rejected altogether.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

What is claimed is:

1. Apparatus for forming an in-turned hem fold at the end of a trouser leg, which comprises (a) spaced apart supporting members for engaging an end portion of the trouser leg internally at opposite sides, (b) at least one of said supporting members being movable laterally to place said trouser leg under circumferential tension, (c) at least outer end portions of said supporting members being of a generally semi-cylindrical configuration, having convex surfaces facing outwardly for supporting end portions of said trouser leg, and having concave surfaces facing inwardly, (d) fold forming elements associated with each of said outer end portions and initially positioned in axially spaced relation with respect to said outer end portions, (e) said fold forming elements having a laterally outwardly facing convex contour generally corresponding to the inwardly facing concave surfaces of said outer end portions, and (f) means for moving said fold forming elements axially with respect to said outer end portions to a position laterally adjacent thereto, inside of and confronting said concave surfaces for forming an internal hem fold of trouser fabric around said outer end portions.

2. An apparatus according to claim 1, wherein (a) a sewing machine is associated with apparatus, in a position to sew a hem stitch circumferentially about the end of said trouser leg after forming of a hem fold, and (b) means for retracting the outer end portions of said support means axially to enable sewing of said trouser leg, (c) said trouser leg being supported by said fold forming elements during said sewing.

3. An apparatus according to claim 2, wherein (a) means are provided for projecting a reference line at a predetermined location adjacent to said fold forming elements for effecting initial alignment of a trouser leg prior to forming a hem fold.

4. An apparatus according to claim 2, wherein (a) said supporting members include rotatably mounted portions engageable with internal portions of said trouser leg to facilitate rotational movement of said trouser leg during alignment and sewing operations.

5. An apparatus according to claim 4, wherein (a) said outer end portions of said support members are retractable within said rotatable portions.

6. An apparatus according to claim 2, wherein (a) means are provided for laterally outwardly displacing said fold forming elements after retraction of said support outer end portions, to maintain hem folded portions of said trouser leg under circumferential tension for sewing.

7. The method of forming an in-turned hem fold at the end of a trouser leg, which comprises, (a) engaging and supporting opposite side inner wall portions of the trouser leg internally and placing and maintaining the trouser leg under circumferential tension, (b) providing a projecting free hem fold margin of fabric at the end of said trouser leg, (c) supporting bottom inner wall portions of the trouser leg internally at opposite sides thereof immediately adjacent said hem fold margin, (d) engaging said hem fold margin externally at opposite sides of said trouser leg and displacing opposite sides of said hem fold margin into the interior of said trouser leg, while continuing to support said bottom portions, to invert said hem fold margin and form a hem fold within said trouser leg.

8. A method according to claim 7, further comprising (a) projecting a reference line toward said trouser leg for alignment of said projecting free hem fold margin.

9. A method according to claim 7, further including (a) while continuing to support said trouser leg, sewing said trouser leg along a circumferential sewing line in the region of said hem fold, (b) during said sewing, supporting said hem fold in the region of said sewing line by engagement of inward facing walls of the folded hem fold margin to maintain said margin under circumferential tension.

10. Apparatus for forming a substantially full-depth small fold on an internal hem of a trouser leg, which comprises (a) spaced apart supporting members for engaging an end portion of the trouser leg internally at opposite sides, (b) means for folding a raw end edge of said trouser leg inward about a large hem fold line to form an internal hem fold on said trouser leg, (c) a small hem forming element positioned within the trouser leg and movable toward and into engagement with the in-folded raw edge of said internal hem fold, over an initial limited length constituting a small fraction of the circumferential length of said internal hem fold, and to a further extended position adjacent said large ham fold line, to form said initial limited length into a small hem fold in which said raw edge is positioned adjacent said large hem fold line, (d) means including a sewing machine sewing bed movable to a sewing position under said small hem fold, arranged to flatten and retain said small hem fold over said initial length, (e) a continuous fold former retractably mounted adjacent said small hem forming element, on the upstream side of a sewing position of said sewing machine, and movable into hem forming position when said sewing machine is moved into a sewing position, for progressive formation of the balance of said small hem during sewing.

11. An apparatus according to claim 10, wherein (a) a retractable retainer element is positioned in association with said small hem forming element and is movable independently of said small hem forming element, and (b) retainer positioning means for advancing said retainer element into contact with said small hem fold, adjacent said raw edge, when said small hem forming element is projected to a forward position, (c) said retainer positioning means being operative to maintain said retainer element in an advanced position until said sewing machine is moved to a position engaging said small hem fold and being operative thereafter to retract said retainer element.

12. An apparatus according to claim 10, wherein (a) control means associated with said continuous fold former for detecting the engagement therewith of a progressing line of hem stitches, (b) said control means being operative thereafter to effect completion of the hem sewing operation over a fixed predetermined distance.

13. The method of forming a substantially full-depth small hem fold on an internal hem of a trouser leg having an open end with a raw fabric edge, which comprises (a) forming an internally folded large hem about a large hem fold line at the open end of said trouser leg, (b) engaging an end portion of said trouser leg internally at opposite sides and placing said end portion and said folded large hem under circumferential tension, (c) pressing forward against a raw edge of said large hem over a limited circumferential length thereof between opposite sides of said trouser leg, to form said limited length into an initial portion of a small hem fold in which said raw edge is positioned closely adjacent said hem fold line, (d) while retaining said small hem fold, bringing a sewing machine into position with its sewing bed in contact with and supporting and retaining said small hem fold, (e) contacting said hem, adjacent its said raw edge, and in a transitional region of said hem upstream of said limited circumferential length thereof and upstream of a sewing position of said sewing machine, with a continuous fold former operative to complete said small hem fold in a progressive manner during sewing.

14. A combination handling apparatus and trouser lea hem folding and sewing work station, which comprises (a) front and back guide bars arranged in generally parallel, spaced apart relation and positioned in front of said work station, (b) said guide bars having opposite end portions extending beyond a predetermined work position of said work station, on opposite sides of said work position, (c) said guide bars defining an elongated space, open at opposite ends, for the reception of a trouser arranged in inverted relation with legs extending upward through said elongated space and initially draped over said front guide bar, and (d) a retaining strip extending along said guide bars and forming a passage for said trouser which is offset from said elongated slot to restrict movement of said trouser at right angles to said guide bars while accommodating movement in the direction of said guide bars.

* * * * *